US006712291B2

(12) United States Patent
Mauchle

(10) Patent No.: US 6,712,291 B2
(45) Date of Patent: Mar. 30, 2004

(54) SPRAY COATING APPARATUS

(75) Inventor: Felix Mauchle, Abtwill (CH)

(73) Assignee: ITW GEMA AG, St. Gallen (CH)

( * ) Notice: Subject to any disclaimer, the term of this patent is extended or adjusted under 35 U.S.C. 154(b) by 2 days.

(21) Appl. No.: 10/254,883

(22) Filed: Sep. 26, 2002

(65) Prior Publication Data

US 2003/0066911 A1 Apr. 10, 2003

(30) Foreign Application Priority Data

Sep. 27, 2001 (DE) ..... 101 47 858

(51) Int. Cl.[7] ..... B05B 15/00
(52) U.S. Cl. ..... 239/289; 239/525; 239/690
(58) Field of Search ..... 239/289, 525, 239/690

(56) References Cited

U.S. PATENT DOCUMENTS 3,764,073 A 10/1973 Costa et al.
4,240,373 A * 12/1980 Anger ..... 118/301
4,574,092 A * 3/1986 Gourdine ..... 427/479
4,611,762 A * 9/1986 Turner et al. ..... 239/708
4,978,070 A * 12/1990 Chow ..... 239/230
5,615,980 A * 4/1997 Mauchle ..... 406/19
5,759,271 A 6/1998 Buschor

FOREIGN PATENT DOCUMENTS

DE 299 00 104 5/2000
EP 0 779 105 A1 6/1997

* cited by examiner

*Primary Examiner*—Hoang Nguyen
(74) *Attorney, Agent, or Firm*—Lowe Hauptman Gilman & Berner LLP

(57) ABSTRACT

A spraycoating apparatus with a tubular, hollow affixation element (16) to affix an adapter (8) to a casing (2), a coating-material tube (14) running through the hollow affixation element (16) into the casing (2).

15 Claims, 3 Drawing Sheets

SPRAY COATING APPARATUS

The present invention relates to spraycoating apparatus defined in the preamble of claim 1.

Spraycoating apparatus of this kind is known from the European patent document 0 779 105 A1 (U.S. Pat. No. 5,759,271).

The invention relates to spraycoating apparatus for liquid coating materials and in particular for coating powders which are pneumatically moved by a flow of compressed air. Such a coating material is sprayed from the front end of a casing through an outlet that illustratively may be the mouth of a material feed duct with or without a transversely deflecting element (baffle or the like), a nozzle or a rotary atomizing element. Preferably the coating material shall be electrostatically charged by electricity of friction and/or by high voltages of more than 1,000 v, for instance using a voltage between 10,000 and 140,00 v to endow said material with improved adhesion to the object to be coated and preferably to be grounded, and in order to reduce dispersion.

The objective of the present invention is reduction of the bulk required by the spraycoating apparatus' feed lines, in particular the bulk subtended by a coating-material tube, and simultaneous simplification of assembly and disassembly of this spraycoating apparatus.

The goal is attained in the present invention by the features of claim 1.

Accordingly the invention relates to spraycoating apparatus containing a casing fitted at its front end with a coating-material discharge element, further with an adapter which is affixed or affixable at its rear end to the casing, and an aperture which is continuous in the longitudinal casing direction, which is characterized in that it comprises a hollow tubular affixation element to affix the adapter to the casing, in that said hollow tubular affixation element may be inserted into the continuous aperture of the adapter in the longitudinal stock direction, in that the hollow tubular affixation element includes an affixation segment to hook up to the casing and a forward-pointing clamping surface allowing clamping the hollow tubular affixation element against the casing, and in that the hollow tubular affixation element exhibits a continuous aperture in the longitudinal stock direction through which the coating-material tube may be plugged in the longitudinal stock direction into the casing.

The invention substantially reduces the bul required by the spraycoating apparatus' feed lines, in particular the bulk required to affix an adapter and to radially position the coating-material tube. This design also simplifies assembly and disassembly of the spraycoating apparatus and the time required for such operations, for instance when cleaning or exchanging its parts.

The dependent claims disclose further features of the invention.

The invention is elucidated below by illustrative embodiments and in relation to the attached drawings.

Figure 1:
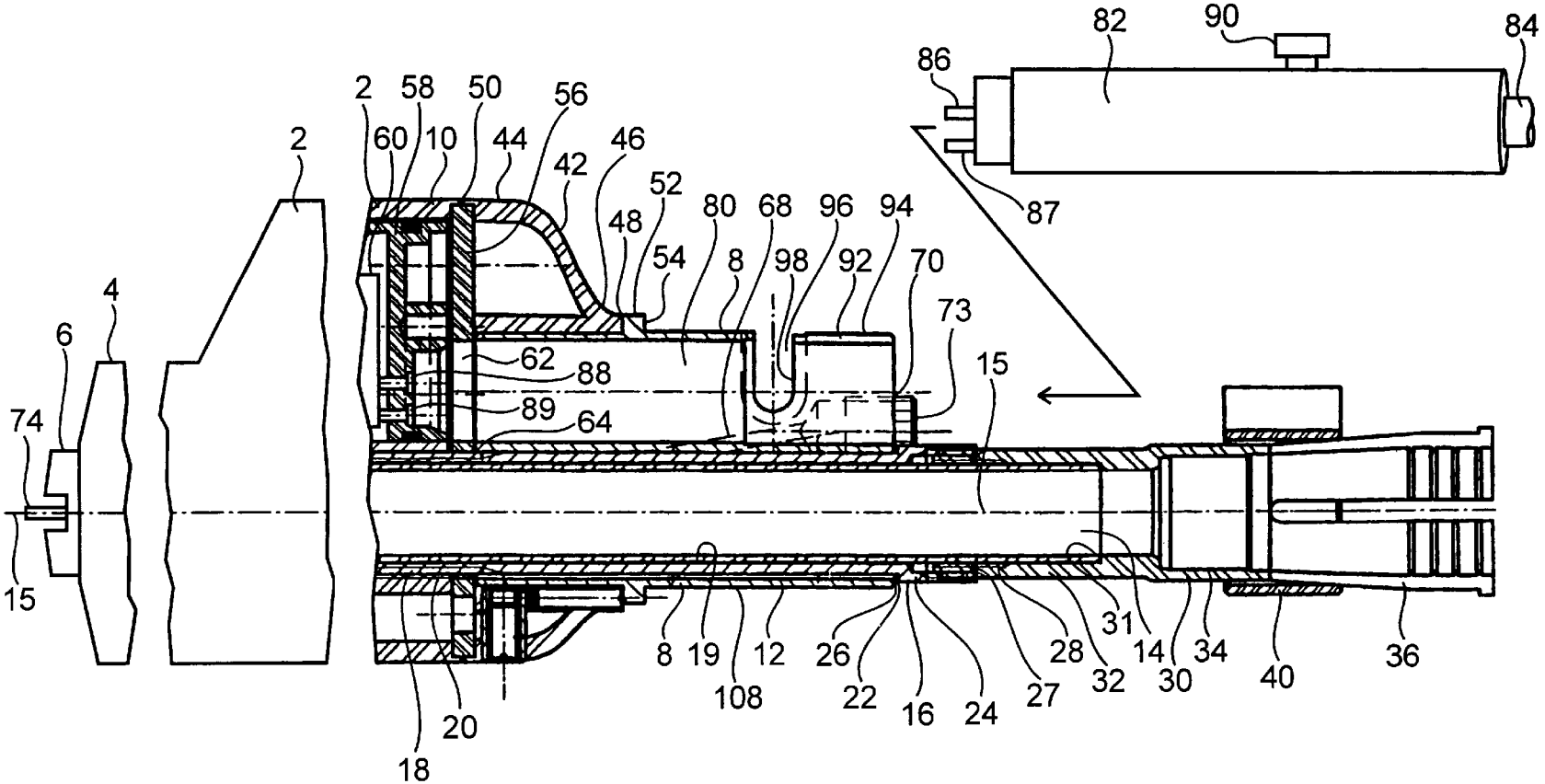
Figure 3:
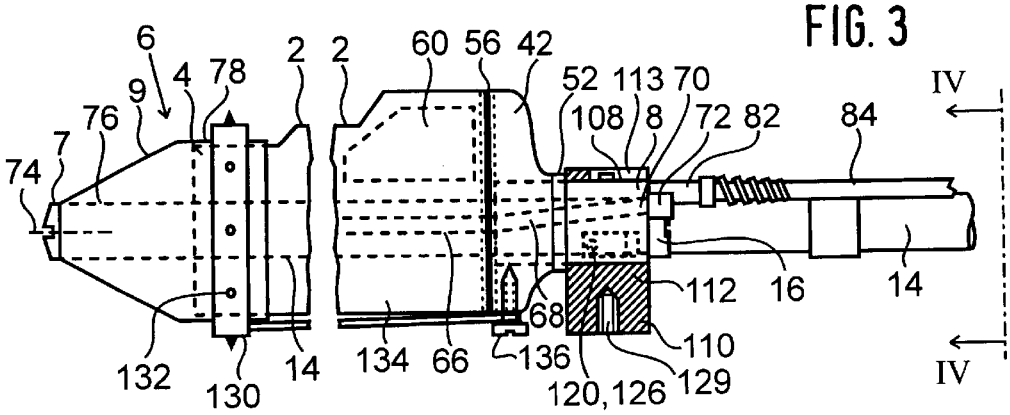
Figure 4:
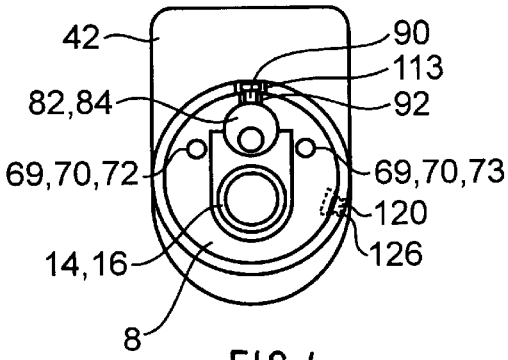
Figure 5:
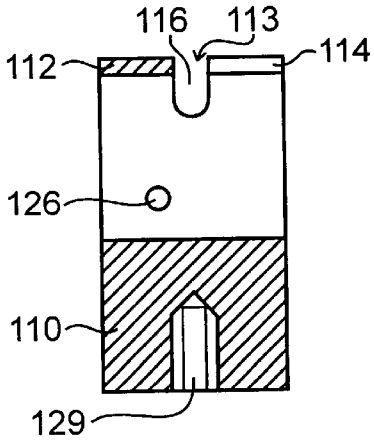
Figure 6:
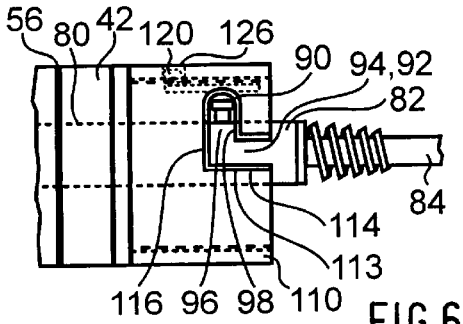
Figure 7:
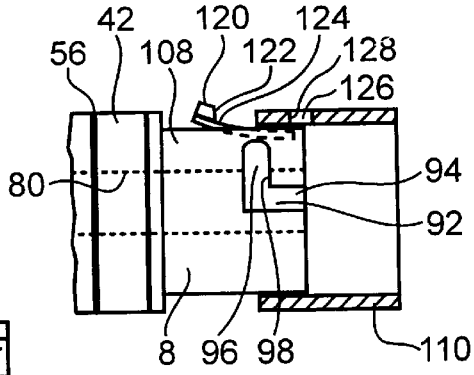
Figure 2:
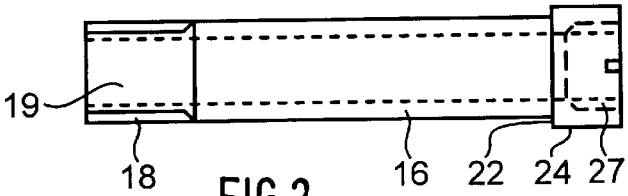
Figure 8:
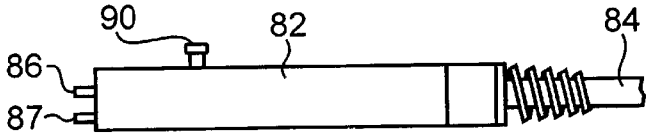
Figure 9:
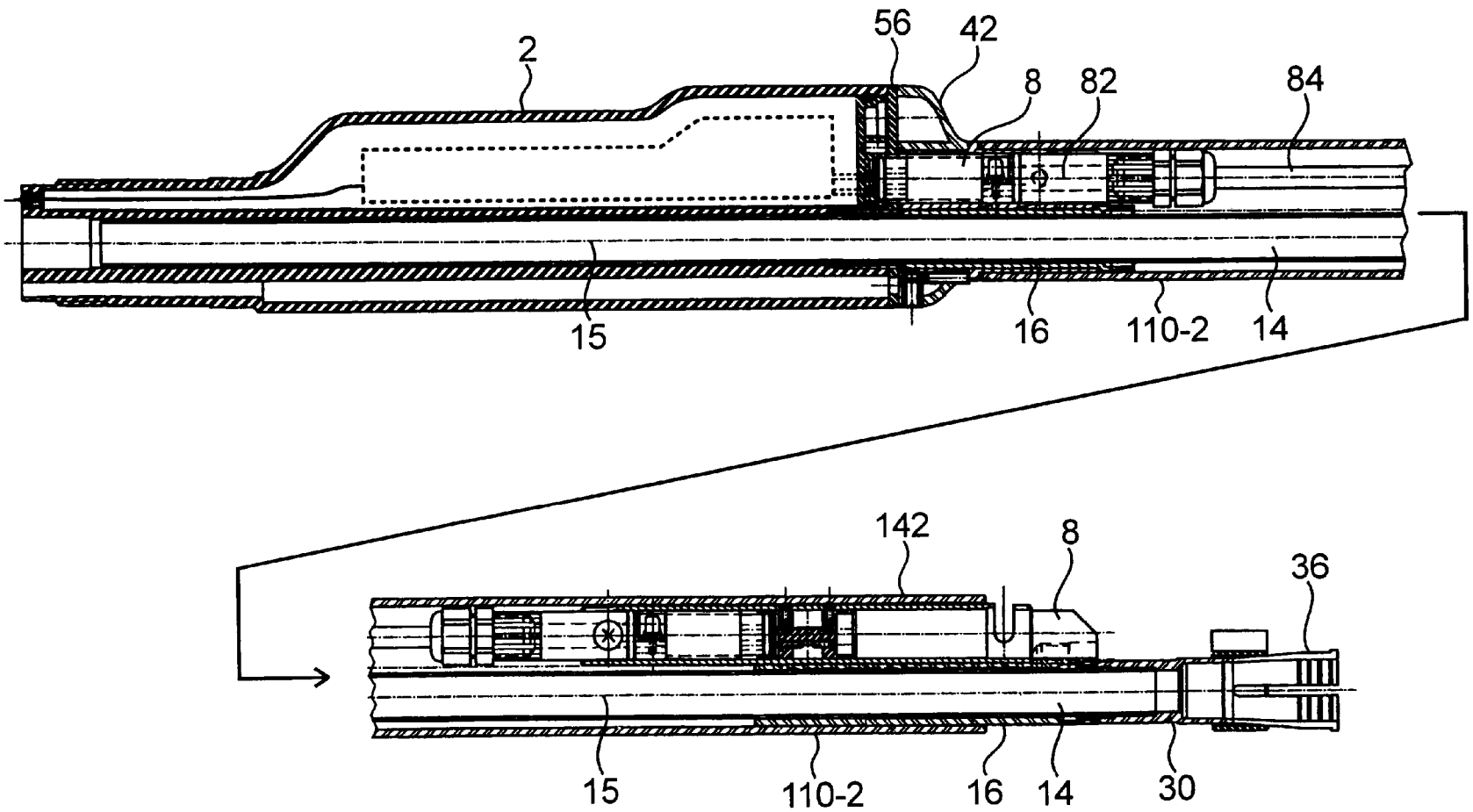

FIG. 1 is a cutaway longitudinal section of spraycoating apparatus of the invention, FIG. 2 is a sideview of a hollow core screw of spraycoating apparatus of the invention (not to scale), FIG. 3 is a sideview of the spraycoating apparatus of the invention (not to scale), FIG. 4 is a backview of the spraycoating apparatus of FIG. 3 seen in the direction of IV—IV of FIG. 3, devoid of a holding element of FIG. 3 and FIG. 5, FIG. 5 is a longitudinal section of a holding element of FIG. 3, FIG. 6 shows a longitudinal section of a component of FIG. 3, FIG. 7 is a top view on a component of FIG. 3, the holding element being shown in horizontal longitudinal section, FIG. 8 is a sideview of a cable adapter of FIG. 3 (not to scale), and FIG. 9 is a longitudinal section of another embodiment of the spraycoating apparatus of the invention shown on a smaller scale.

Preferably the spraycoating apparatus of the invention is designed to spraycoating powder being pneumatically conveyed in a flow of compressed air. In another embodiment of the invention however, said apparatus may be designed to spray liquid coating material.

The spraycoating apparatus shown in the attached drawings contains a casing 2, a coating-material spray head 6 being affixed or affixable to the front end 4 of said housing and constituting a coating-material feed outlet. An adapter 8 is affixed or affixable to the rear end of the casing in order to connect with at least one element comprises a continuous aperture 12 running in the longitudinal direction of the casing 2 and allowing insertion of a coating-material tube 14 feeding coating material.

Illustratively and as shown in FIG. 3, the spray head 6 may contain a nozzle 7 affixed by a coupling nut 9 to the front segment of the casing 2.

A hollow screw 16 is used to affix the adapter 8 to the casing 2. The hollow core screw 16, hereafter called "hollow screw", can be inserted in the longitudinal direction of the casing 2 through the continuous aperture 12 of the adapter 8 and together with the wall of said aperture 12 preferably shall constitute a sliding seat. The hollow screw 16 comprises an axial, continuous duct 19 in the longitudinal direction of the casing 2 to receive the coating-material tube 14. The hollow screw 16 is preferably fitted with an outside thread 18 preferably situated at its front end to screw into a complementary thread 20 in the casing 2, and it further comprises a forward-pointing clamping surface 22 of a bolt head 24 allowing to clamp the adapter 8 against the casing 2. In this design the forward-pointing clamping surface 22 will be clamped against a rearward pointing end face 26 or a rearward-pointing cross-sectional surface of the adapter 8. The coating-material tube 14 and the hollow screw 16 exhibit a central longitudinal axis 15.

The wall of the continuous duct 19 of the hollow screw 16 rests against the coating-material tube 14, preferably along its entire circumference, and together with it constitutes a sliding seat.

Preferably the casing 2 is integral and made of plastic. In another embodiment mode, it may also consist of several parts and/or of another, electrically conducting or preferably electrically insulating material.

The thread 20 of the casing 2 used to affix the hollow screw 16 preferably is constituted by the very casing 2. In another embodiment mode, a threaded element also may be anchored in this casing 2.

Preferably the adapter 8 is a metallic and integral element in order it be electrically conducting and serve as an electrical conductor which is optionally grounded. In another embodiment said adapter may be made of an electrically insulating material, for instance plastic.

The hollow screw 16 defines the radial position of the coating-material tube 14 relative to the adapter 8 and thereby also relative to the casing 2 and it radially supports said coating-material tube 14. Preferably the two elements shall abut each other directly radially with so little play that preferably they shall be radially jitter-free.

Another tubular hollow affixation element than the hollow screw 16 also may be used. The thread 18 may be replaced by another hollow tubular affixation element 18 of a different geometry that can be hooked up to an appropriate affixation element of the casing 2 (said element being part of the casing or inserted into it or affixed to it). Illustratively either the hollow affixation element 16 or the casing 2 may be designed as a male connector and the other one as the matching female connector. Preferably the affixation segment of the hollow affixation element shall be the male part and the affixing element of the casing shall be the hookup element. One of said two elements may comprise a pawl or another locking element which shall engage a stop surface running transversely to the coating-material tube. For instance one of the two said elements may be fitted with a cross-pin which may be inserted into an L-shaped groove constituted in the other element and thereupon be rotatable in the manner of a bayonet lock.

In all embodiments, the connection between the hollow affixation element 16 (preferably hollow screw 16) and the casing can be unlatched and released in order to separate the hollow affixation element again from the casing 2 and hence also removing said element from the adapter 8 for the purpose of separating all three parts from each other for instance for cleaning and/or exchanging them with other elements.

In what follows the hollow, tubular affixation element 16 is called according to the shown embodiment mode "hollow screw 16" and represents all other embodiments of such a hollow, tubular affixation element as well. In the shown and preferred embodiment, the coating-material tube 14 preferably is designed to be affixed to the hollow affixation element 16 or hollow screw 16 and in the process can be locked in place axially. This affixation is detachable in order that the coating-material tube 14 may be removed and cleaned or exchanged. Preferably the affixation is implemented by an inside thread 27 (or outside thread) at the rear end or at the head 24 of the hollow screw 16 and a meshing outside thread 28 (or inside thread) constituted at the coating-material tube 14 or, corresponding to FIG. 1, to a hose adapter 30 receiving the rear end of the coating-material tube 14, said rear end then being clamped toward a forward-pointing transverse surface 31. However, instead of the connection of threads 27, 28, the coating-material tube 14 also may be connected with the hollow screw 16 by a locking male/female connection or another quick-connect means for instance in the manner of a bayonet lock.

The coating-material tube 14 and the hose adapter 30 preferably are made of an electrically insulating material, in particular plastic.

Opposite its front tube-receiving segment 32, the hose adapter 30 is fitted with a rearward-pointing female segment 34 receiving a coating-material hose, and with a terminal segment which projects rearward from there and comprises forward slots dividing it into fingers 36 that, using a tightening ring 40, can be clamped on the hose.

The outside circumference of the adapter 8 at its front end differs from that of the casing 2 and according to the embodiment illustratively is less than the circumference of the rear end of the casing 2. However different ratios of these circumferences also are admissible. A junction element 42 comprises a front end 44 matching the periphery of the casing 2 and a rear end 46 matching the periphery of the adapter 8. The junction element 42 may be axially clamped in place by the hollow screw 16 between a forward pointing transverse surface 48 of the adapter 8 and a rearward pointing end face 50 of the casing 2. The forward pointing transverse surface 48 is constituted by an annular rib 52 which furthermore constitutes a rearward pointing transverse surface 54.

The junction element 42 matches the contour and size of the circumference of the rear end of the casing 2 to the contour and size of the circumference of the adapter 8.

In another (omitted) embodiment mode, the shape and size of the front end of the adapter 8 matches the shape and size of the rear end 10 of the casing 2, whereby a junction element 42 is no longer required. In this design too the adapter 8 may comprise a rearward pointing transverse surface 54 of a similar rearward-pointing stop surface cooperating with a support that shall be described further below.

Preferably a longitudinal groove and a longitudinal rib are constituted in either of the adapter 8 and the junction element 42 in order to rotationally position the two parts relative to each other.

A seal 56 is mounted between the adjacent end faces on one hand of the rear end of the casing 2 and on the other hand of the front end of the junction element 42. Preferably this seal shall be an elastic disk or plate in order that it may also rest in sealing manner against other elements corresponding to FIG. 1. The sealing plate 56 is axially clamped by the hollow screw 16 between rearward pointing surfaces of the casing 2 and a partition 58 behind a high-voltage generator 60, both situated in the casing 2, on one hand, and on the other hand forward pointing surfaces of the adapter 8 and of the junction element 42, so that all said components be mutually sealed. The sealing plate 56 is fitted with feedthroughs for lines or ducts, for instance with a borehole 62 to be used for an electrical connection, which shall be described further below, to the high-voltage generator 60, furthermore a borehole 64 for the hollow screw 16 and boreholes for one or more compressed-air paths (or none).

Preferably at least one compressed-air duct 66 runs longitudinally and continuously through the casing 2, for instance one each on each side next the coating-material tube 14 as schematically shown in FIG. 3. The rear end of each compressed-air duct 66 is axially opposite the front end of each compressed-gas borehole 68 running longitudinally through the adapter 8 and is fitted at its rear end with a thread 70 cooperating with an adapter nipple 72 of an omitted compressed-gas hose or with a closing screw 73. The mutually opposite ends communicate—as regards flow—through a borehole constituted in the sealing plate 56. In the embodiment of FIGS. 1, 3 and 4, there are two compressed-gas boreholes 68 in the adapter 8 and they are configured one on each side of the hollow screw 16 and the coating-material tube 14. Two compressed-gas ducts 66 are constituted in the casing 2. One compressed-gas flowpath 66, 68 illustratively supplies compressed air or another gas which flows over one or more high-voltage electrodes 74 which are configured beyond, at or in the front end of, the casing 2, and which receive high voltage from the high-voltage generator 60 to electrostatically charge the coating material. The other compressed-gas flowpath 66, 68 may serve to feed compressed air or another gas for other purposes, for instance for atomizing, shaping or otherwise controlling the flow of coating material.

As shown in FIG. 1, part of the adapter 8 is designed as a socket 80 receiving and affixing a cable adapter 82 of an electric power cable 84. The socket 80 runs in the longitudinal direction of the casing 2 parallel to the feedthrough 12 receiving the hollow screw 16.

Preferably the socket 80 shall be a feedthrough constituted in the adapter 8 and assuming the function of the female receiving the cable adapter 82 acting as the male.

The cable adapter 82 is fitted at its front end with at least one electrically conducting terminal 86, 87 to contact at least one electrically conducting terminal 88, 89 configured at the rear end of the casing 2 in the partition 58 to assure low-voltage application by the cable 84 to the high-voltage generator 60.

The cable adapter 82 preferably comprises an electrically conducting case which on one hand is connected to an electric grounding wire in the cable 84 and on the other hand makes electrical contact inside the socket 80 with the adapter 8.

In another, omitted embodiment, the high-voltage generator 60 is mounted not inside the casing 2, but externally to it. In that design the cable 84 is not a low-voltage cable, but a high-voltage one, which transmits the high voltage from an external high-voltage generator 60 into the casing 2 and within same to the minimum of one high-voltage electrode 74.

At least one (two or more in other embodiment modes) locking protrusion 90 is constituted at the cable adapter 82 and a locking path 92 is constituted at the adapter 8, said path 92 comprising a path segment 94 that runs in the longitudinal direction of the socket 80, that is open toward the rear and that is adjoined transversely by a peripheral path segment 96 fitted with a forward-pointing locking surface 98 behind which the locking protrusion 90 inserted into the longitudinal path segment 94 may be rotated by turning the cable adapter 82 relative to the adapter 8.

In another embodiment—also omitted—the locking protrusion 90 is constituted at the adapter 8 and the locking path 92 is constituted at the cable adapter 82. In an embodiment variation, other locking elements are provided between the cable adaptor 82 and the adapter 8, for instance pawls, clamping elements or threads.

The rear segment 108 of the adapter 8 projecting rearward from the junction element 42 and comprising the locking path 92 is designed as an affixation zone for affixation to a support 110. The support 110 comprises a tubular affixation segment 112 that may be plugged onto the affixation segment 108 of the adapter 8 and that constitutes thereon a jitter-free socket.

The rearward pointing transverse surface 54 of the adapter 8 acts as a stop for the support 110 of which it defines the position on the adapter 8.

As shown in FIGS. 3 and 6, the support 110 in its tubular affixation segment 112 may be fitted with an L-shaped clearance 113 constituted by a longitudinal clearance 114 running forward from the rear end of the support 110 and by a circumferential zone 116 which adjoins said longitudinal clearance 114 at its front end, said elements 114 and 116 being mountable on the adapter 8 while congruent with the L-shaped locking path 92 of the cable adapter 82. In this manner the locking protrusion 90 of the cable adapter 82 may simultaneously and optionally function as a locking protrusion to axially lock the support 110 on the adapter 8.

However, in addition or instead, the support 110 as shown in FIGS. 3, 4, 5, 6 and 7, may be secured in position axially and/or circumferentially on the adapter 8 using a resilient pawl 120, for instance a pawl head 122 on a resilient strip 124 and affixed to one of the two components, namely the adapter 8 or the support 110, and able to engage a transverse aperture 126 constituted at the respectively other of the two components, namely adapter 8 or support 110. As regards the shown preferred embodiment, the transverse aperture 126 has been fitted into the support 110 and the pawl 120 is mounted in radially resilient manner on the adapter 8. The pawl 120 automatically engages the transverse aperture 126 once the support 110 being mounted on the adapter element 108 has reached its axial and circumferential end positions. The transverse aperture 126 runs transversely to the longitudinal direction of the feedthrough aperture 12 receiving the hollow screw 16. The resilient strip 124 runs inside a longitudinal groove of the adapter 8.

As shown in FIG. 7, the transverse aperture 126 constitutes a rearward pointing locking surface 128 entered by the pawl 120. Unintended removal of the support 110 from the adapter 8 is prevented thereby. To remove the pawl 120 from the locking surface 128, it must be manually forced away transversely and thus out of the transverse aperture 126.

The support 110 may be amounted to a rest means, for instance a jack or a robot arm or a grip. For this purpose and for the embodiment of FIGS. 3 and 5, the support 110 is fitted with at least one threaded borehole 129 running transversely to the hollow screw 16.

FIG. 3 furthermore shows a system to drain charged particles, namely excess electric charges, in particular ions, from the high-voltage electrode 74, where such charges do not contribute to electrostatically charging the coating material either because it is already saturated with electrical charges or because the charged particles are so far from this coating material that they cannot charge it. This drain system contains for instance a ring 130 with a plurality of drain electrodes 132 which are electrically connected by an electrically conducting bar 134 and an electrical contact pin 136, for instance a screw, inside the junction element 42 to the adapter 8. The adapter 8 may be grounded through the cable adapter 82 and the cable 84.

As shown by FIG. 9, the support 110, which is limited to the length of the adapter 8, may be replaced by a tubular support element 110-2 made optionally of an electrically insulating but preferably an electrically conducting material which is designed at its front end in the same manner as the support 110 of FIG. 3 but is devoid of a threaded borehole 129. The coating-material tube 14 and further all other lines supplying material and/or power run through the support element 110-2, in particular the cable 84 and compressed-gas lines for the various compressed gases, for instance compressed air, illustratively being moved through the compressed-air ducts 66 in the casing 2 (FIG. 3). A second adapter 8 (of the same or of a different design as the first adapter 8) is present at the rear end 142 of the tubular support element 110-2 and allows longitudinally passing the coating-material tube 14 inside a second hollow screw 16 and connecting a further electrical cable 84 with a cable adapter 82. Also compressed-air ducts 68 may be contained in the second adapter 8 in the manner described above in relation to the other Figures.

What is claimed is:

1. Spraycoating apparatus comprising a casing (2) of which the front end (4) is fitted with a coating-material outlet (6), further comprising an adapter (8) affixed or affixable to the rear end (10) of the casing (2) and a continuous aperture (12) running the longitudinal casing direction, characterized in that it also comprises a tubular hollow affixation element (16) to affix the adapter (8) to the casing (2), in that the hollow affixation element (16) is insertable in the longitudinal casing direction into the continuous aperture (12) of the adapter (8), in that the hollow affixation element (16) comprises a connecting segment (18) for connection to the casing (2) and a forward-pointing clamping surface (22) whereby the adapter (8) can be clamped toward the casing (2) by linking the hollow affixation element (16) to the casing (2), and in that the affixation element (16) comprises a continuous aperture (19) in the longitudinal casing direction, the coating-material tube (14) being plugged in the longitudinal casing direction into the casing (2) by being made to pass through said continuous aperture.

2. Spraycoating apparatus as claimed in claim 1, characterized in that the hollow affixation element (16) is a hollow screw of which the connecting segment is fitted with a thread (18) which shall be screwed into a thread (20) at the casing (2).

3. Spraycoating apparatus as claimed in claim 1, characterized in that the coating-material tube (14) can be affixed (27, 28, 31) by means of the hollow affixation element (16).

4. Spraycoating apparatus as claimed in claim 1, characterized in that the front end of the adapter (8) exhibits an outside circumference which is different from that of the rear end (10) of the casing (2) and in that a junction element (42) is used which is fitted with a front end (44) matching the circumference of the casing (2) and a rear end (46) matching the circumference of the adapter forward-pointing transverse surface (48) of the adapter (8) and a rearward-pointing surface (50) of the casing (2) while passing through the tubular hollow affixation element (16).

5. Spraycoating apparatus as claimed in claim 1, characterized in that a seal (56) which is hermetic to compressed air rests in sealing manner between and against adjacent end faces of the casing (2) and the adapter (8).

6. Spraycoating apparatus as claimed in claim 4, characterized in that a seal (56) is mounted between adjacent end faces of the casing (2) and/or components (58) received therein on one hand and on the other hand the junction (42) and rests against said faces in sealing manner.

7. Spraycoating apparatus as claimed in claim 1, characterized in that at least one compressed-gas duct (68) runs through the adapter (8), the front end of said duct being opposite the rear end of at least one compressed-gas duct (66) constituted in the casing (2), the said adapter implementing the transmission of compressed gas.

8. Spraycoating apparatus as claimed in claim 1, characterized in that a portion of the adapter (8) is a socket (80) to receive and affix a cable adapter (82) of an electric power cable (84).

9. Spraycoating apparatus as claimed in claim 8, characterized in that the socket (80) comprises a continuous aperture running from the rear to fore to receive the cable adapter (82), in that the cable adapter (82) is fitted at its front end with at least one electrically conducting terminal (86, 87) to make contact with at least one electrically conducting terminal (88, 89) configured at the rear end of the casing (2).

10. Spraycoating apparatus as claimed in claim 8, characterized in that at least one of the two components "adapter (8)" or "cable adapter (82)" is fitted with at least one transversely projecting locking protrusion (90) and the related other component with a locking path (92) to receive the locking protrusion, in that the locking path comprises a path segment (94) open toward the rear and running in the longitudinal direction ofthe continuous aperture of the socket (80) for the cable adapter (82) and a circumferential path segment (96) with a forward-pointing locking surface (98) to the rear of which the locking protrusion (90) inserted longitudinally from rear to fore into the path segment (94) can be rotated by rotating the cable adapter (82) relative to the adapter (8).

11. Spraycoating apparatus as claimed in claim 1, characterized in that the rear, tubular end of the coating-material tube (14) is fitted with a hose adapter (34, 36) to hook up a hose.

12. Spraycoating apparatus as claimed in claim 1, characterized in that the adapter (8) comprises an affixation segment (108) for affixation to a support (110) which constitutes a jitter-free seat on the affixation segment (108).

13. Spraycoating apparatus as claimed in claim 12, characterized in that a resilient pawl (120) is affixed transversely to the longitudinal direction of the coating-material tube (14) of one of the two components ["adapter (8)" or "support (110)"] and in that the pertinent other of the two components (8, 110) is fitted with a locking surface (128) which can be automatically engaged from behind by the spring-loaded pawl (120) when the support (110) has been plugged onto the adapter (8) as far as a defined end position, in order that said two components shall be prevented from separating axially.

14. Spraycoating apparatus as claimed in claim 1, characterized in that at least one electrode (132), draining charged particles through an electrically conducting part of the adapter (8) is voltage electrode (74) electrically charging the coating material.

15. Spraycoating apparatus as claimed in claim 4, characterized in that the junction (42) is fitted on its inside with an electrical terminal (136) to contact an electrically conducting part of the adapter (8) so that a connection may be set up between the electrical terminal (136) and an electrical conductor (134) connected to the minimum of one electrode (132) draining charged particles.

* * * * *